US008846289B2

(12) United States Patent
Ogawa et al.

(10) Patent No.: US 8,846,289 B2
(45) Date of Patent: Sep. 30, 2014

(54) METHOD OF MANUFACTURING TONER AND TONER MANUFACTURED BY THE METHOD

(75) Inventors: Satoshi Ogawa, Nara (JP); Tsuyoshi Sugimoto, Mishima (JP); Naohito Shimota, Numazu (JP); Hiroshi Yamashita, Numazu (JP); Masana Shiba, Numazu (JP); Junichi Awamura, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 358 days.

(21) Appl. No.: 12/889,759

(22) Filed: Sep. 24, 2010

(65) Prior Publication Data

US 2011/0076610 A1 Mar. 31, 2011

(30) Foreign Application Priority Data

Sep. 28, 2009 (JP) ..... 2009-222189

(51) Int. Cl.

*G03G 9/00* (2006.01)
*G03G 9/087* (2006.01)
*G03G 9/08* (2006.01)

(52) U.S. Cl.

CPC ..... *G03G 9/0804* (2013.01); *G03G 9/08795* (2013.01); *G03G 9/08782* (2013.01); *G03G 9/08797* (2013.01); *G03G 9/08755* (2013.01)
USPC ..... 430/137.18; 430/137.14; 430/137.1; 430/137.19

(58) Field of Classification Search

CPC ..... G03G 9/09321; G03G 9/09328; G03G 9/0825; G03G 9/09725; G03G 9/0827; G03G 9/0819; G03G 9/08755; G03G 9/08782; G03G 9/08795; G03G 9/08797; G03G 9/0804; G03G 9/0802; G03G 9/0808
USPC ..... 430/109, 137.1–137.22
See application file for complete search history.

(56) References Cited

U.S. PATENT DOCUMENTS

| | | | | |
|---|---|---|---|---|
| 2004/0265721 | A1* | 12/2004 | Matsuoka et al. | 430/109.4 |
| 2008/0226356 | A1 | 9/2008 | Yasunaga et al. | |
| 2008/0227009 | A1 | 9/2008 | Fuwa et al. | |
| 2008/0233506 | A1 | 9/2008 | Hagi et al. | |
| 2008/0318148 | A1* | 12/2008 | Sugimoto et al. | 430/108.4 |
| 2009/0041511 | A1 | 2/2009 | Fuwa et al. | |
| 2009/0068579 | A1 | 3/2009 | Ogawa et al. | |
| 2009/0155710 | A1 | 6/2009 | Aoki et al. | |
| 2009/0233218 | A1 | 9/2009 | Ogawa | |
| 2009/0297225 | A1* | 12/2009 | Yamada et al. | 399/252 |
| 2010/0227266 | A1 | 9/2010 | Ogawa et al. | |

FOREIGN PATENT DOCUMENTS

| | | |
|---|---|---|
| JP | 2000-081728 | 3/2000 |
| JP | 3044595 | 3/2000 |
| JP | 2002-296839 | 10/2002 |
| JP | 2004-309788 | 11/2002 |
| JP | 3478963 | 10/2003 |
| JP | 2004-295046 | 10/2004 |
| JP | 2007-72333 | 3/2007 |
| JP | 2007-121481 | 5/2007 |
| JP | 2007-206097 | 8/2007 |
| JP | 2007-264333 | 10/2007 |
| JP | 2009-3024 | 1/2009 |
| JP | 2009-069533 | 4/2009 |

OTHER PUBLICATIONS

Office Action issued Jul. 10, 2013, in Japan Patent Application No. 2009-222189.

* cited by examiner

*Primary Examiner* — Christopher Rodee
*Assistant Examiner* — Omar Kekia
(74) *Attorney, Agent, or Firm* — Oblon, Spivak, McClelland, Maier & Neustadt, L.L.P.

(57) ABSTRACT

A method of manufacturing toner including melting, mixing, and kneading a releasing agent and a coloring agent with at least part of a polyester binder resin, and suspending and granulating an oil phase comprising the binder resin, the coloring agent, and the releasing agent in an aqueous medium.

11 Claims, No Drawings

METHOD OF MANUFACTURING TONER AND TONER MANUFACTURED BY THE METHOD

BACKGROUND OF THE INVENTION

1. Field of the Invention

The present invention relates to a method of manufacturing a toner, and the toner manufactured by the method.

2. Description of the Background

With the number of output images per unit of time increasing year by year, there is market demand for ever-faster image forming apparatuses. However, to satisfy this demand for higher-speed performance, severe technical hurdles must first be cleared, as described below.

At present, electrophotography is widely used in the field of on-demand digital printing. In particular, the fixing temperature range for fixing an unfixed toner image on a recording medium is required to be fairly wide to prevent occurrence of offset without at the same time adversely affecting gloss.

However, the thermal energy that can be provided to the toner per unit of time at the fixing device is limited and is difficult to increase. On the contrary, of late the thermal energy used tends to be reduced because of concern for the environment. Therefore, the toner tends not to be heated sufficiently, which leads to insufficient melting of the toner present on or near the surface of the recording medium. The toner that is not melted sufficiently during fixing has an insufficient viscosity and thus is severed at the toner layer on the recording medium. Therefore, one part of the toner remains on the recording medium and the other on the fixing roller.

Alternatively, such insufficient melting results in a weak attachment between the recording medium and the toner, in which case all the toner on the recording medium attaches, i.e., offsets, to the fixing roller.

The toner that is caused to adhere to the fixing roller is likely to be fixed at an unwanted portion, i.e., non-image portion, on the following transferred recording media, which causes production of abnormal images with ghost images. That is, a phenomenon known in the art as offset, referred to as cold offset in this case, occurs in the absence of sufficient heat.

In addition, even when the cold offset phenomenon does not occur, insufficient melting of the toner during fixing causes degradation of the quality of the output image such that the gloss decreases markedly.

To solve these problems pertaining to insufficient melting, intensive research and development have been conducted on how to manufacture a toner containing resins, releasing agents, fixing property improver, etc., having a low melting point in order to improve the low temperature fixing property.

For example, Japanese patent application publication no. 2007-72333 (JP-2007-72333-A) describes a teaching of regulating the difference in the endothermic peak of a toner between prior to the thermal treatment to the toner and after preservation thereof for 72 hours at 45° C. In addition, for example, JP-2007-206097-A describes a method of improving the low temperature fixing property, high temperature storage, and offset resistance of a toner by regulating the ratio of the Fourier transform infrared (FTIR) spectrum of the crystalline polyester contained in the toner as a raw material between prior to preservation at a high temperature and after preservation for 12 hours at 45° C.

Similarly, Japanese patent no. 3478963 describes a method of improving color reproduction property at high density, offset resistance, and characteristics of charge rising by regulating the amount of charge of a toner (that is, ratio Z of charge rising obtained by $Q_{20}/Q_{600}\times100$, where $Q_{20}$ represents the amount of charge obtained after a toner having a density of 5% is stirred and mixed with a carrier for 20 seconds and $Q_{600}$ represents the amount of charge obtained after the toner is stirred and mixed with the carrier for 10 minutes) in addition to regulation of the dispersion diameter of the coloring agent in the binder resin contained in the toner and the dispersion diameter of the releasing agent contained therein.

However, a toner that has excellent low-temperature fixing property generally tends to deteriorate when stored in a high-temperature environment, resulting in solidification of the toner. That is, there is a trade-off between the low temperature fixing property and the high temperature storage.

Therefore, in view of the demand for faster image forming apparatuses, it is desirable to have a toner that can be fixed at low thermal energy. However, such a toner is inferior with regard to storage under high-temperature conditions, so that handling of the toner in a high-temperature environment becomes problematic. Conversely, a toner exhibiting excellent high-temperature storage is difficult to have a good low temperature fixing property, which leads to occurrence of the cold offset phenomenon, etc., thereby causing image quality problems.

One conceivable solution to the above-described conundrum is pulverized toner. In the manufacture of pulverized toner through processes of melting, mixing and kneading, a method is widely used that prevents attachment and offset of the toner to a fixing roller by heating, mixing and kneading two or more kinds of resins having different molecular weights or rheology to impart a good fixing property at low temperatures by melting the resins having a small molecular weight, and a good fixing property at high temperatures by melting the resin having a large molecular weight or a high elasticity/viscosity, thereby providing a wide temperature range for fixing without causing attachment and offset of the toner to the fixing roller at a low temperature and a high temperature (refer to Japanese patent no. 3044595, etc.).

However, when at least two kinds of resins having an extremely different molecular weight or rheology are melted, mixed and kneaded to obtain a wide fixing temperature range, a shear force is not provided to the resins during mixing and kneading according to the difference among the viscosities of the resins, resulting in non-uniform dispersion of the toner. In this case, the portion having a high viscosity and the portion having a low viscosity form a sea-and-island type of structure. In addition, dispersal of the pigment, the releasing agent, or the charge control agent deteriorates sharply, thereby degrading the performance of the machine in terms of fixing, image density evenness, fogging, and particularly the quality of images (color saturation or chromaticness).

This problem is markedly noticeable and difficult in the case of a high-speed machine for which outputting quality images is necessary even as while the thermal energy provided per unit of time is reduced. The decrease in saturation described above results in production of images with serious problems. Therefore, this is one of the urgent problems to be solved for pulverized toners.

On the other hand, color image forming apparatuses are common which include no oil supply unit for the fixing device and use a toner containing a releasing agent in place of supplying oil.

However, it is difficult to manufacture a releasing agent having as small a particle diameter as that of coloring agent, and moreover, uniform addition and dispersion is also difficult to achieve. The releasing agent that is unevenly dispersed and exposed to the surface of the toner particles has a relatively low melting point, and is highly crystalline and brittle, which has an adverse impact on durability, storage, and anti-spent property.

As methods of improving the dispersion property of such a releasing agent, for example, JP-2004-295046-A describes using a master batch thereof prepared by preliminarily melting, mixing and kneading the releasing agent and a resin. However, since the master batch uses a resin having a small molecular weight, the shear force is weak and the releasing agent easily bleeds out during melting, mixing and kneading. Therefore, the releasing agent is not sufficiently dispersed.

For these reasons, the present inventors recognize that a need exists for a method of manufacturing a toner having a good combination of a high temperature offset resistance, gloss, and low temperature fixing and excellent in storage, fixing property, color reproduction property, and image quality, and the toner provided by this method.

SUMMARY OF THE INVENTION

Accordingly, an object of the present invention is to provide a novel method of manufacturing a toner having a good combination of high-temperature offset resistance, gloss, and low temperature fixing and excellent in storage, fixing property, color reproduction property, and image quality, and the toner manufactured by this method.

Briefly this object and other objects of the present invention as hereinafter described will become more readily apparent and can be attained, either individually or in combination thereof, by a method of manufacturing toner including melting, mixing, and kneading a releasing agent and a coloring agent with at least part of a polyester binder resin and suspending and granulating an oil phase comprising the binder resin, the coloring agent, and the releasing agent in an aqueous medium.

It is preferred that, in the method of manufacturing toner mentioned above, the releasing agent is a hydrocarbon-based wax modified by a carboxylic acid or an anhydride of a carboxylic acid.

It is still further preferred that, in the method of manufacturing toner mentioned above, the melting point of the releasing agent is lower than the melting point of the binder resin.

It is still further preferred that, in the method of manufacturing toner mentioned above, the melting point of the releasing agent ranges from 70 to 110° C.

It is still further preferred that, in the method of manufacturing toner mentioned above, the acid value of the releasing agent ranges from 3 to 20 mgKOH/g.

It is still further preferred that, in the method of manufacturing toner mentioned above, the acid value of the polyester resin ranges from 5 to 40 mgKOH/g.

It is still further preferred that, in the method of manufacturing toner mentioned above, the releasing agent has a viscosity of from 5 to 50 can poise at 90° C.

It is still further preferred that, in the method of manufacturing toner mentioned above, the coloring agent comprises a press cake pigment formed by washing and filtering the pigment.

It is still further preferred that the melting, mixing, and kneading of the binder resin, the releasing agent, and the coloring agent is conducted using an open-type melting, mixing and kneading machine.

As another aspect of the present invention, an improved toner manufactured by the method of manufacturing toner described above is provided.

These and other objects, features and advantages of the present invention will become apparent upon consideration of the following description of the preferred embodiments of the present invention.

DETAILED DESCRIPTION OF THE DISCLOSURE

According to the intensive and various kinds of studies on methods of manufacturing a toner having a good combination of a high temperature offset resistance, gloss, and low temperature fixing and excellent in storage, fixing property, color reproduction property, and image quality, the present inventors have acquired knowledge about an effective method of manufacturing a toner by suspending and granulating in an aqueous medium an oil phase containing a binder resin, a coloring agent, and a releasing agent. That is, the binder resin is a polyester resin, and the releasing agent and the coloring agent in the oil phase are preliminarily melted, mixed, and kneaded with at least part of the polyester resin to form a coloring agent dispersion body. Thus, the present inventors have made the present invention.

Generally, the releasing agent is required to be finely dispersed in the binder resin, and thus, the binder resin and the releasing agent are dissolved and dispersed in a solvent.

However, in such a dispersion method, a releasing agent having a relatively small molecular weight is necessary to select to dissolve the releasing agent in the solvent.

In addition, a problem occurs such that the solvent boils by heat generated during dissolution.

A releasing agent that has a small molecular weight is good at releasing property but has an adverse impact on the high temperature and humidity storage and anti-spent property when the releasing agent exposes to the surface of toner particles.

As a result of studies on such dispersion of the releasing agent in a binder resin, the present inventors pay attention to the fact that when the releasing agent and the binder resin are melted, mixed and kneaded, the releasing agent is desirably dispersed in the binder resin irrespective of the molecular weight of the releasing agent and therefore, a releasing agent that has a relatively large molecular weight can be selected in the present invention.

The toner manufactured by this method has not only a good releasing property and but also a good anti-spent property.

In addition, by melting, mixing and kneading the coloring agent with the releasing agent and the binder resin, shear force during mixing and kneading is easily provided. Also, since the wettability of the coloring agent against the binder resin is improved, the dispersion property of the coloring agent is also improved. Thus, a toner having an excellent color reproduction property is obtained.

In the toner described in the present disclosure, the releasing agent that is melted, mixed, and kneaded is preferably a hydrocarbon based wax modified by a carboxylic acid, or anhydride of carboxylic acid.

Since the hydrocarbon based wax acid-modified by a carboxylic acid, or anhydride of carboxylic acid is highly crystalline, and sharp melt, the wax is excellent in releasing property and easy to disperse in a binder resin. Therefore, the wax is suitable to manufacture a toner having an excellent storage and anti-spent property.

In addition, the releasing agent that is melted, mixed, and kneaded with a binder resin preferably has a melting point lower than that of the binder resin.

When the melting point of the releasing agent is higher than that of the binder resin, the releasing agent is difficult to bleed out to the surface of the toner during fixing. Therefore, good releasing agent is hardly obtained.

To the contrary, when the melting point of the releasing agent is lower than that of the binder resin, the releasing agent bleeds out to the surface of the toner during fixing. Therefore, the releasing agent easily oozes between the toner layer and the fixing member, resulting in demonstration of excellent releasing property.

In addition, the toner of the present disclosure preferably uses a releasing agent having a melting point of from 70 to 110° C.

A releasing agent that has an excessively low melting point tends to have an adverse impact on the storage of the toner in a high temperature and high moisture environment, resulting in solidification thereof.

To the contrary, a releasing agent that has an excessively high melting point tends to be not melted during fixing. Therefore, such a releasing agent has a high viscosity and thus is difficult to demonstrate a good releasing property.

Therefore, a toner having a good releasing property and a storage is obtained by using a releasing agent having a melting point of from 70 to 110° C.

In addition, the toner of the present disclosure preferably uses a releasing agent having an acid value of from 3 to 20 mgKOH/g.

When the acid value is too small, the releasing agent tends to be hardly dispersed in a binder resin. An acid value that is to large tends to have an adverse impact on the chargeability of the toner depending on the environment.

For example, charging decreases in a high temperature and high moisture environment, which leads to background fouling and scattering of the toner.

When the releasing agent has an acid value of from 3 to 20 mgKOH/g, a toner that has an excellent dispersion property and good image output property in a high temperature and high moisture environment.

In addition, the toner of the present disclosure preferably uses a polyester resin having an acid value of from 5 to 40 mgKOH/g as the binder resin.

The acid value of the polyester resin contributes to the dispersion property of the releasing agent. Therefore, an acid value of the polyester resin that is too small tends to make it difficult to disperse the releasing agent suitably.

On the other hand, considering the impact from the environment, the acid value is preferably not greater than 40 mgKOH/g.

When the acid value is too high, charging decreases in a high temperature and high moisture environment, which leads to background fouling and scattering of the toner, etc.

In addition, the toner of the present disclosure preferably uses a releasing agent having a viscosity of from 5 to 50 can poise at 90° C.

This viscosity relates to the releasing effect.

Since a releasing agent having a small viscosity tends to bleed out to the surface of toner particles, when the viscosity of the releasing agent is too small at 90° C., the toner surface is easily contaminated by the wax, resulting in deterioration of chargeability of the toner.

When the viscosity of the releasing agent is too large at 90° C., the wax component is hardly out to the surface of toner particles. Therefore, the releasing agent does not demonstrate its releasing effect.

In addition, in the toner of the present disclosure, it is preferable to use a press cake pigment obtained after washing and filtration as a coloring agent in the process of preliminarily melting, mixing, and kneading a binder resin, a releasing agent, and a coloring agent.

The press cake pigment contains water between pigment particles. Therefore, a toner having an excellent pigment dispersion property is obtained without agglomeration by replacing the binder resin during the melting, mixing and kneading process In addition, in the toner of the present disclosure, it is preferable to melt, mix, and knead a binder resin, a releasing agent, and a coloring agent with an open type melting, mixing and kneading machine in the process of preliminarily melting, mixing, and kneading the binder resin, the releasing agent, and the coloring agent.

The open type melting, mixing and kneading machine can release the heat generated during shearing. Therefore, the binder resin, the releasing agent, and the coloring agent can be mixed and kneaded at a relatively low temperature.

Therefore, since mixing and kneading at a relatively low temperature can impart a high shearing force to a material, a toner having a good pigment dispersion property can be manufactured.

In the polyester resin for use in the present disclosure, an adduct of a propylene oxide of the bisphenols is preferably used as the diol component in terms of the dispersion property of the pigment. In addition, the adduct is contained in an amount of 50 mol % or more based on the diol component for use in polymerization of the polyester resin.

The amount is more preferably 50 mol % or more, and furthermore preferably 80 mol % or more.

The toner has a good color reproduction property and pigment dispersion property in a combination of a polyester resin containing an adduct of a propylene oxide more than a predetermined amount and a dispersion agent polymer (i.e., a polyester derivative having a predetermined acid value and amino value) as the diol component.

The mechanism of this is not clear, but the affirmation of the polyester resin and the dispersion agent polymer is improved, which leads to stabilization of a pigment.

Alcohols and acids other than the adducts of the propylene oxide of the bisphenols can be arbitrarily selected in consideration of the glass transition temperature, the molecular weight, the softening point, etc. of the polyester resin.

The hydroxyl value and the acid value can be adjusted by adding an alcohol or acid having a tri- or more functional groups.

Specific examples of the diol components other than the adducts of the propylene oxide of the bisphenols include, but are not limited to, alkylene glycols such as ethylene glycol, 1,2-propylene glycol, 1,3-propylene glycol, 1,4-butane diol, and 1,6-hexane diol; diols having an oxyalkylene group such as dietylene glycol, triethylene glycol, dipropylene glycol, polyethylene glycol, polypropylene glycol, and polytetramethylene glycol; adduct of alicyclic diols such as 1,4-cyclohexane dimethanol, and hydrogenated bisphenol A; adducts of alicyclic diols with alkylene oxides such as ethylene oxide, propylene oxide, and butylene oxide; bisphenols such as bisphenol A, bisphenol F, and bisphenol S; and adducts of bisphenols with alkylene oxides such as ethylene oxide, propylene oxide, and butylene oxide.

The number of carbon atoms of the alkylene glycols is preferably from 2 to 12.

Among these, an alkylene glycol or an adduct of a bisphenol with an alkylene oxide having a 2 to 12 carbon atoms are preferable. An adduct of a bisphenol with an alkylene oxide and a mixture of an adduct of a bisphenol with an alkylene oxide and an alkylene glycol having a 2 to 12 carbon atoms are particularly preferable.

In addition, tri- or higher alcohols can be also used. Specific examples thereof include, but are not limited to, fatty alcohols having three or more hydroxyl groups, polyphenols having three or more hydroxyl groups, and adducts of polyphenols having three or more hydroxyl groups with alkylene oxides.

Specific examples of the fatty alcohols having three or more hydroxyl groups include, but are not limited to, glycerin, trimethylol ethane, trimethylol propane, pentaerythritol, and sorbitol.

Specific examples of the polyphenols having three or more hydroxyl groups include, but are not limited to, trisphenol PA, phenol novolac, and cresol novolac.

Specific examples of the adducts of polyphenols having three or more hydroxyl groups with alkylene oxides include, but are not limited to, adducts of polyphenols having three or more hydroxyl groups with alkylene oxides such as ethylene oxide, propylene oxide, and butylene oxide.

Polycarboxylic acids are used as the acid component.

Polycarboxylic can be suitably selected to the purpose. Dicarboxylic acids, tri- or higher carboxylic acids and mixtures of dicarboxylic acids and tri- or higher carboxylic acids can be used. Among these, dicarboxylic acids and mixtures of dicarboxylic acids with a small amount of tri- or higher carboxylic acids are preferable. These can be used alone or in combination.

Specific examples of the diols include, but are not limited to, alkanoic dicarboxylic acids, alkene dicarboxylic acids, and aromatic dicarboxylic acids.

Specific examples of the alkanoic dicarboxylic acids include, but are not limited to, succinic acid, adipic acid, and sebacic acid.

The number of the carbon atoms of the alkene dicarboxylic acids is preferably from 4 to 20. Specific examples thereof include, but are not limited to maleic acid, and fumaric acid.

The number of the carbon atoms of the aromatic dicarboxylix acids is preferably from 8 to 20. Specific examples thereof include, but are not limited to phthalic acid, isophhtalic acid, terephthalic acid, and naphthalene dicarboxylic acid.

Among these compounds, alkenylene dicarboxylic acids having 4 to 20 carbon atoms and aromatic dicarboxylic acids having from 8 to 20 carbon atoms are preferably used.

Specific examples of tri- or higher carboxylic acids include, but are note limited to, aromatic tri- or higher carboxylic acids.

The number of the carbon atoms of the aromatic tri- or higher carboxylic acids is preferably from 9 to 20. Specific examples thereof include, but are not limited to trimellitic acid, and pyromellitic acid.

Specific examples of the polycarboxylic acids include, but are not limited to, acid anhydrides or lower alkyl esters of any of dicarboxylic acids, tri- or higher carboxylic acids, and mixtures of dicarboxylic acids and tri- or higher carboxylic acids.

Specific examples of the lower alkyl esters include, but are not limited to, methyl esters, ethyl esters, and isopropyl esters.

When the dicarboxylic acid and the tri- or higher carboxylic acid are mixed, the ratio of the tri- or higher carboxylic acids to the dicarboxylic acid is preferably from 0.01 to 10% and more preferably from 0.01 to 1%.

The mixture ratio of the polyol and the polycarboxylic acid is poly-condensed, the equivalent ratio of the hydroxyl group of the polyol to the carboxylic group of the polycarboxylic acid is preferably from 1 to 2, more preferably from 1 to 1.5 and particularly preferably from 1.02 to 1.3.

Any known coloring agents can be used as the coloring agent for the toner for each color of yellow, magenta, and cyan.

Specific examples of the coloring agents for yellow toner include, but are not limited to, azo-based pigments such as C.I. Pigment Yellow 1, C.I. Pigment Yellow 5, C.I. Pigment Yellow 12, C.I. Pigment Yellow 15, and C.I. Pigment Yellow 17 according to the classification by the color index, and inorganic pigments such as yellow iron oxide, and yellow ocher.

Specific examples of yellow dyes include, nitro-based dyes such as C.I. acid yellow 1, and oil soluble dyes such as C.I. Solvent Yellow 2, C.I. solvent yellow 6, C.I. Solvent Yellow 14, C.I. Solvent Yellow 15, C.I. Solvent Yellow 19, and C.I. Solvent Yellow 21.

Particularly, benzidine based pigments such as C.I. Pigment Yellow 17 are preferable in terms of color taste.

Specific examples of the coloring agents for magenta toner include, but are not limited to, C.I. Pigment Red 49, C.I. Pigment Red 57, C.I. Pigment Red 81, C.I. Pigment Red 122, C.I. Solvent Red 49, C.I. Solvent Red 52, C.I. Basic Red 10, C.I. Disperse Red 10 and C.I. Disperse Red 15. Particularly, quinacridone based pigments such as C.I. Pigment Red 122 are preferable in terms of color taste.

Specific examples of the coloring agents for cyan toner include, but are not limited to, C.I. Pigment Blue 15, C.I. Pigment Blue 16, C.I. Solvent Blue 55, C.I. Solvent Blue 70, C.I. Direct Blue 25, and C.I. Direct Blue 86. Particularly, copper phthalocyanine pigments based pigments such as C.I. Pigment Blue 15 are preferable in terms of color taste.

With regard to the coloring agent, a coloring agent dispersion body is prepared in which the coloring agent is preliminarily melted, mixed, kneaded and dispersed together with the releasing agent in the binder resin before adjusting an oil phase in which the coloring agent, the binder resin and the releasing agent are dissolved in an organic solvent.

The temperature during melting, mixing and kneading is equal to or higher than the melting temperature of the binder resin.

In addition, specific examples of the kneaders include, but are not limited to, a one-axis kneader extruder, a two-axis kneader extruder, a two-roll kneader, and a three-roll kneader. Continuous type two-roll kneaders are preferable to improve the dispersion property of the releasing agent and the coloring agent.

In this kneader, the roll gap on the kneaded mixture discharging side is made to be wider than that on the material placement side. Therefore, the mixing and kneading force of an open roller type kneader in which a strong shearing force generally applies across the entire of the kneading and mixing portion is concentrated on the first half portion, i.e., the material placement portion, and the performance of the second half portion is mainly mixing by melting. Therefore, generation of the heat of melting and kneading is limited, thereby improving the mixing and kneading effect.

Furthermore, one in the two rolls provided close to each other is a heating roll via a heating medium and the other is a cooling roll via a cooling medium, thereby demonstrating a strong shearing force. Therefore, the dispersion property of the releasing agent and the coloring agent is improved.

Specific examples of the wax as the releasing agent in the present disclosure include, but are not limited to, natural waxes such as animal waxes such as bees wax, cetaceum, rice wax, and shellac wax, vegetable waxes such as carnauba wax, wood wax, rice wax, and Candellia wax, oil waxes such as paraffin wax, and microcrystalline wax, and mineral waxes such as montan wax, and ozokerite. Other than these natural waxes, also the following synthetic waxes can be used: synthetic hydro carbon waxes such as Fischer-Tropsch (synthesis) waxes and polyethylene waxes, synthetic waxes such as esters, ketones and amides, and hydrogenated waxes.

There is no specific limit to the kinds of the waxes. In terms of releasing property, it is preferable to use waxes prepared by modifying hydrocarbon waxes obtained by separation and refinement of distillation component under reduced pressure of oil with carboxylic acids, etc.

Paraffin wax is of low viscosity at a relatively low temperature and has a low needle penetration value. In addition, the acid value of paraffin wax is easily controlled by modification.

The addition amount of the wax for use in the present disclosure is preferably from 1 to 20 parts by weight based on 100 parts by weight of the binder resin in consideration of the releasing property, storage in a high temperature and high humidity environment and chargeability.

When the addition amount is too small, the releasing effect tends to be insufficient. When the addition amount is too large, the wax is easily affected by the environment. Therefore, the addition amount of the wax is preferably from 3 to 10 parts by weight.

A charge control agent is suitably used for the toner of the present disclosure.

Any known charge control agent can be used. Since the color toner changes when a colored material is used, a clear or close to white material is preferably used for the charge control agent.

Specific examples of the charge control agent include, but are not limited to, triphenylmethane dyes, chelate compounds of molybdic acid, Rhodamine dyes, alkoxyamines, quaternary ammonium salts including fluorine-modified quaternary ammonium salts, alkylamides, phosphor and compounds including phosphor, tungsten and compounds including tungsten, fluorine-containing surface activators, metal salts of salicylic acid, metal salts of salicylic acid derivatives, etc.

These can be used alone or in combination.

Specific examples of the marketed products of the charge controlling agents include, but are not limited to, BONTRON P-51 (quaternary ammonium salt), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; quinacridone, azo pigments and polymers having a functional group such as a sulfonate group, a carboxyl group, a quaternary ammonium group, etc.

The content of the charge control agent in the toner depends on the kind of the binder resin, presence of additives, and dispersion method but is preferably from 0.1 to 10% by weight and more preferably from 0.2 to 5% by weight to the binder resin.

When the content is too low, desired charge control property is not easily obtained. When the content is too high, the toner tends to have an excessively large amount of charge Therefore, the electrostatic attraction force between a developing roller and the toner increases, resulting in deterioration of the fluidity of a development agent containing the toner and a decrease in the image density.

The weight average molecular weight of the binder resin contained in the oil phase is preferably from 1,000 to 30,000 and more preferably from 1,500 to 15,000.

When the weight average molecular weight is too small, the high temperature storage tends to deteriorate.

Therefore, the content of the component having a weight average molecular weight less than 1,000 is preferably from 8 to 28% by weight.

In addition, when weight average molecular weight is too large, the low temperature fixing property tends to deteriorate.

The glass transition temperature of the binder resin is preferably from 30 to 70° C., more preferably from 35 to 60° C. and more preferably from 35 to 55° C.

When the glass transition temperature is too low, the high temperature preservation property of the toner may deteriorate. When the glass transition temperature is too high, the low temperature fixing property may deteriorate.

The acid value of the binder resin is preferably from 5 to 40 mgKOH/g.

Within this range, the dispersion property of the releasing agent and the coloring agent is improved and a toner having good coloration, releasing property, storage in a high temperature and high moisture environment and chargeability is obtained.

Any known aqueous medium can be selected.

To be specific, water, a solvent mixable with water, and a mixture thereof can be used. Among these, water is particularly preferable.

Specific examples of such solvents include, but are not limited to, alcohols, dimethylformamide, tetrahydrofuran, cellosolves, lower ketones.

Specific examples of the alcohols include, but are not limited to, methanol, isopropanol and ethylene glycol.

Specific examples of the lower ketones include, but are not limited to, acetone and methyl ethyl ketone.

These can be used alone or in combination.

In the present disclosure, in the oil phase that contains a toner material containing at least the binder resin, the coloring agent and the releasing agent, the toner material is preferably dissolved or dispersed in a solvent.

The solvent preferably contains an organic solvent.

The organic solvent is preferably removed when or after mother toner particles are formed.

Such an organic solvent is suitably selected and preferably has a boiling point of 150° C. or lower because removal thereof becomes easy.

Specific examples of such organic solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc.

Among these, toluene, xylene, benzene, methylene chloride, 1,2-dichloroethane, chloroform, and carbon tetrachloride are preferable and ethyl acetate is particularly preferable.

These can be used alone or in combination.

The content of the organic solvent is determined to the purpose and preferably from 40 to 30 parts by weight, more preferably from 60 to 140 parts by weight, and furthermore preferably from 80 to 10 parts by weight based on 100 parts by weight of the toner material.

Any known toner material can be selected. Generally, the toner material contains at least a binder resin, a releasing agent, and a coloring agent. The binder resin preferably contains a compound having an active hydrogen group, and polymer having a portion reactive with the compound having an active hydrogen group, and other optional components such as charge control agent.

The weight ratio in the mixture of the coloring agent and the organic solvent in the oil phase containing the toner material is determined depending on purpose and preferably from 5:95 to 50:50.

When the ratio of the coloring agent is too small, the content of the organic solvent is too large when the toner is manufactured, thereby reducing the manufacturing efficiency of the toner. When the ratio of the coloring agent is too large, the dispersion of the pigment tends to be insufficient.

The content of the pigment in the toner can be suitably determined and is of from 3 to 20% by weight and preferably from 5 to 12% by weight against the toner.

When the content of the coloring agent is too small, the coloring performance of the toner tends to deteriorate. To the contrary, when the content of the coloring agent is too great, dispersion of the pigment in the toner tends to be insufficient, thereby degrading the coloring performance and the electric characteristics of the toner.

When the toner material is emulsified or dispersed in an aqueous medium using the oil phase containing the toner material, it is preferable to disperse the oil phase containing the toner material in the aqueous medium while stirring. Any known dispersion device can be used for dispersion.

Specific examples of the dispersion device include, but are not limited to, a low speed shearing type dispersion device, a high speed shearing type dispersion device, a friction type dispersion device, a high pressure jet type dispersion device, and an ultrasonic dispersion device.

Among these, the high speed shearing type dispersion device is preferable because it can control the particle diameter of the dispersion body, i.e., oil droplet, in the range of from 2 to 20 μm.

When the high speed shearing type dispersion device is used, conditions such as the number of rotation, the dispersion time, and the dispersion temperature are suitably selected.

The number of rotation is preferably from 1,000 to 30,000 rpm, and more preferably from 5,000 to 20,000 rpm.

The dispersion time is preferably from 1 to 5 minutes in the case of the batch system. The dispersion temperature is preferably from 0 to 150° C. and more preferably from 40 to 98° C. under pressure.

Generally, dispersion is easy at a high temperature.

Any known method is usable as the method of forming mother toner particles.

Specific examples thereof include, but are not limited to, a method of forming mother toner particles using a dissolution suspension method, etc., and a method of forming mother toner particles while preparing an adhesive base material.

Among the two, the method of forming mother toner particles while preparing an adhesive base material is preferable.

The adhesive base material represents base materials having adhesiveness to a recording medium such as paper.

The method by which mother toner particles are formed while forming a binder resin is a method in which mother toner particles are formed by reacting a toner material including a compound having active hydrogen groups and a polymer having a portion reactive with a compound having active hydrogen groups in an aqueous medium to form mother toner particles.

The thus obtained toner contains a suitably selected optional component, for example, a charge control agent.

A suitable example of the polymer having a portion reactive with a compound having active hydrogen groups suitably is a modified polyester based resin reactive with a compound having active hydrogen groups.

The modified polyester based resin reactive with a compound having active hydrogen groups is preferably a polyester having an isocyanate group as a polymer reactive with active hydrogen groups.

A urethane linking can be formed by adding alcohols when reacting a polyester having an isocyanate group and a compound having active hydrogen groups.

The molar ratio of the thus formed urethane linking to the urea linking (to distinguish the urethane linking from the urethane linking contained in the polyester prepolymer having an isocyanate group) is preferably from 0 to 9, more preferably from 1/4 to 4, and particularly preferably from 2/3 to 7/3.

When this ratio is too large, the anti-offset property may deteriorate.

The compound having an active hydrogen group serves as an elongation agent, cross-linking agent, etc. in the elongation reaction, cross-linking reaction, etc. of the polymer having a portion reactive with a compound having active hydrogen groups in an aqueous medium.

Specific examples of the active hydrogen group include, but are not limited to, hydroxyl groups (alcohol hydroxyl groups and phenol hydroxyl groups), amino groups, carboxyl groups, and mercarpto groups.

The active hydrogen group can be a sole group or a mixture of two or more kinds.

Any known compound having an active hydrogen group can be suitably used. However, amines are preferable when a polymer having a portion reactive with a compound having active hydrogen groups is a polyester prepolymer having an isocyanate group because the resultant can have a large molecular weight through elongation reaction, cross-linking reaction, etc.

Any amines can be suitably used. Specific examples thereof include, but are not limited to, diamines, tri- or higher amines, amino alcohols, aminomercaptanes, amino acids, and blocked amines. Diamines and mixtures in which a diamine (B1) is mixed with a small amount of a polyamine (B2) are preferred.

These can be used alone or in combination.

Specific examples of the diamines include, but are not limited to, aromatic diamines, alicyclic diamines, and aliphatic diamines.

Specific examples of the aromatic diamines include, but are note limited to, phenylene diamines, diethyl toluene diamines, and 4,-4'-diamino diphenyl methane.

Specific examples of the alicyclic diamines include, but are not limited to, 4,4'-diamino-3,3-dimethyl dicyclohexyl methane, diaminocyclohexane and isophoron diamine.

Specific examples of the aliphatic diamines include, but are not limited to, ethylene diamine, tetramethylene diamine, and hexamethylene diamine.

Specific examples of the polyamines having three or more amino groups include, but are not limited to, diethylene triamine, and triethylene tetramine.

Specific examples of the amino alcohols include, but are not limited to, ethanol amine and hydroxyethyl aniline.

Specific examples of the amino mercaptan include, but are not limited to, aminoethyl mercaptan and aminopropyl mercaptan.

Specific examples of the amino acids include, but are not limited to, amino propionic acid and amino caproic acid.

Specific examples of the blocked amines include, but are not limited to, ketimine compounds which are prepared by reacting an amino group with a ketone such as acetone, methyl ethyl ketone and methyl isobutyl ketone, and oxazoline compounds.

A reaction terminator can be used to terminate the elongation reaction, cross-linking reaction, etc. of a compound having an active hydrogen group with a polymer having a portion reactive with a compound having active hydrogen groups.

The molecular weight of the adhesive base material can be controlled in a desired range by using a reaction terminator.

Specific examples of the reaction terminator include, but are not limited to, monoamines such as diethyl amine, dibutyl amine, butyl amine, and lauryl amine, and blocked amines, (i.e., ketimine compounds) prepared by blocking the amino groups of the monoamines mentioned above.

The equivalent ratio of the isocyanate group of the polyester prepolymer to equivalent weight of the amino group of the amine is preferably from 1/3 to 3/1, more preferably from 1/2 to 2/1, and particularly preferably from 2/3 to 3/2.

When the ratio is too small, the low temperature fixing temperature may become lower. When the ratio is too large, the molecular weight of the urea-modified polyester resin tends to decrease, which leads to deterioration of hot offset resistance.

Any known polymer having a portion reactive with a compound having active hydrogen groups (hereinafter referred to as prepolymer) can be suitably used. Specific examples thereof include, but are not limited to, polyol resins, polyacrylic resins, polyester resins, epoxy resins and derivatives thereof.

Among these, polyester resins are preferable in terms of high fluidity and clearness during melting.

These can be used alone or in combination.

Specific examples of the portion in the prepolymer that is reactive with a compound having an active hydrogen group include, but are not limited to, functional groups such as epoxy groups, carboxyl groups, and functional groups represented by —COCl. Among these, isocyanate groups are preferable.

Such a prepolymer may have one or two or more functional groups specified above.

As the prepolymer, it is preferred to use a polyester resin having, for example, an isocyanate group, which can produce an urea linkage, since the molecular weight of a polymer component can be easily controlled and oil-free low temperature fixing property and releasing property of a drying toner can be secured even when there is no releasing oil application mechanism to a heating medium for fixing.

Any known polyester prepolymer having an isocyanate group can be suitably used.

Specific examples thereof include, but are not limited to, a reaction product of a polyester resin having an active hydrogen group obtained by polycondensation of a polyol and a polycarboxylic acid, and a polyisocyanate.

Polyols can be suitably selected. For example, diols, polyols having three or more hydric group and a mixture of diols and polyols having three or more hydric groups can be used. Diols or mixtures of a diol with a small amount of polyols having three or more hydric groups are preferred.

These can be used alone or in combination.

Specific examples of the diols include, but are not limited to, alkylene glycols such as ethylene glycol, 1,2-propylene glycol, 1,3-propylene glycol, 1,4-butanediol and 1,6-hexanediol; diols having oxyalkylene groups such as diethylene glycol, triethylene glycol, dipropylene glycol, polyethylene glycol, polypropylene glycol and polytetramethylene ether glycol; alicyclic diols such as 1,4-cyclohexane dimethanol and hydrogenated bisphenol A; adducts of alicyclic diols with an alkylene oxide such as ethylene oxide, propylene oxide, and butylene oxide; bisphenols such as bisphenol A, bisphenol F, and bisphenol S; and adducts of bisphenols with an alkylene oxide such as ethylene oxide, propylene oxide, and butylene oxide.

The number of carbon atoms of the alkylene glycols is preferably from 2 to 12.

Among these, an alkylene glycol or an adduct of a bisphenol with an alkylene oxide having 2 to 12 carbon atoms are preferable. An adduct of a bisphenol with an alkylene oxide and a mixture of an adduct of a bisphenol with an alkylene oxide and an alkylene glycol having a 2 to 12 carbon atoms are particularly preferable.

Specific examples of the tri- or higher alcohols include, but are not limited to, fatty alcohols having three or more hydroxyl groups, polyphenols having three or more hydroxyl groups, and adducts of polyphenols having three or more hydroxyl groups with alkylene oxides.

Specific examples of the fatty alcohols having three or more hydroxyl groups include, but are not limited to, glycerin, trimethylol ethane, trimethylol propane, pentaerythritol, and sorbitol.

Specific examples of the polyphenols having three or more hydroxyl groups include, but are not limited to, trisphenol PA, phenol novolac, and cresol novolac.

Specific examples of the adducts of polyphenols having three or more hydroxyl groups with alkylene oxides include, but are not limited to, adducts of polyphenols having three or more hydroxyl groups with alkylene oxides such as ethylene oxide, propylene oxide, and butylene oxide. When a diol and a tri- or higher alcohol are mixed, the ratio of the tri- or higher alcohol to the diol is preferably from 0.01 to 10% and more preferably from 0.01 to 1%.

Polycarboxylic can be suitably selected. Dicarboxylic acids, tri- or higher carboxylic acids and mixtures of dicarboxylic acids and tri- or higher carboxylic acids can be used. Among these, dicarboxylic acids and mixtures of dicarboxylic acids with a small amount of tri- or higher carboxylic acids are preferable.

These can be used alone or in combination.

Specific examples of the dicarboxylic acids include, but are not limited to, alkanoic dicarboxylic acids, alkene dicarboxylic acids, and aromatic dicarboxylic acids.

Specific examples of the alkanoic dicarboxylic acids include, but are not limited to, succinic acid, adipic acid, and sebacic acid.

The number of the carbon atoms of the alkene dicarboxylic acids is preferably from 4 to 20. Specific examples thereof include, but are not limited to maleic acid, and fumaric acid.

The number of the carbon atoms of the aromatic dicarboxylix acids is preferably from 8 to 20. Specific examples thereof include, but are not limited to phthalic acid, isophhtalic acid, terephthalic acid, and naphthalene dicarboxylic acid.

Among these compounds, alkenylene dicarboxylic acids having 4 to 20 carbon atoms and aromatic dicarboxylic acids having from 8 to 20 carbon atoms are preferably used.

Specific examples of tri- or higher carboxylic acids include, but are note limited to, aromatic tri- or higher carboxylic acids.

The number of the carbon atoms of the aromatic tri- or higher carboxylic acids is preferably from 9 to 20. Specific examples thereof include, but are not limited to trimellitic acid, and pyromellitic acid.

Specific examples of the polycarboxylic acids include, but are not limited to, acid anhydrides or lower alkyl esters of any of dicarboxylic acids, tri- or higher carboxylic acids, and mixtures of dicarboxylic acids and tri- or higher carboxylic acids.

Specific examples of the lower alkyl esters include, but are not limited to, methyl esters, ethyl esters, and isopropyl esters.

When the dicarboxylic acid and the tri- or higher carboxylic acid are mixed, the ratio of the tri- or higher carboxylic acids to the dicarboxylic acid is preferably from 0.01 to 10% and more preferably from 0.01 to 1%.

The mixture ratio of the polyol and the polycarboxylic acid is poly-condensed, the equivalent ratio of the hydroxyl group of the polyol to the carboxylic group of the polycarboxylic acid is preferably from 1 to 2, more preferably from 1 to 1.5 and particularly preferably from 1.02 to 1.3.

The content of the composition deriving from the polyol in the polyester prepolymer having an isocyanate group is from 0.5 to 40% by weight, preferably from 1 to 30% by weight, and more preferably from 2 to 20% by weight.

A content that is too low may degrade the hot offset resistance of the toner and be disadvantageous in terms of a combination of the high temperature storage and low temperature fixability. By contrast, when the content is too high, the low temperature fixability of the toner easily deteriorates.

Polyisocyanate can be selected among known products. Specific examples thereof include, but are not limited to, aliphatic diisocyanates, alicyclic polyisocyanates, aromatic diisoycantes, aromatic aliphatic diisocyanates, isocyanurates, and blocked polyisocyanates in which the polyisocyanates mentioned above are blocked with phenol derivatives, oximes or caprolactams.

Specific examples of the aliphatic di-isocyanates include, but are not limited to, tetramethylene diisocyanate, hexamethylene diisocyanate and 2,6-diisocyanate methylcaproate, octamethylene diisocyanate, decamethylene diisocyanate, dodecamethylene diisocyanate, tetradecamethylene diisocyanate, trimethyl hexane diisocyanate, and tetramethyl hexane diisocyanate.

Specific examples of the aliphatic diisocyanates include, but are not limited to, isophorone diisocyanate and cyclohexylmethane diisocyanate.

Specific examples of the aromatic diisoycantes include, but are not limited to, tolylene diisocyanate, diphenylmethane diisocyanate, 1,5-naphtylene diisocyanate, 4,4-diisocyanate-3,3'-dimethyldiphenyl, 4,4'-diisocyanate-3-methyl diphenylmethane, and 4,4'-diisocyanate-diphenyl ether.

Specific examples of the aliphatic diisocyanates include, but are not limited to, α, α, α', α'-tetramethyl xylylene diisocyanate.

Specific examples of the isocyanurates include, but are not limited to, tris(isocyanate alkyl)isocyanulate, and tris(isocyanate cycloalkyl)isocyanulate.

These can be used alone or in combination.

When a polyisocyanulate is caused to react with a polyester resin having a hydroxyl group, the equivalent ratio (i.e., [NCO]/[OH]) of the isocyanulate group of a polyisocyanate to the hydroxyl group of a polyester resin varies preferably from 1 to 5, more preferably from 1.2 to 4 and particularly preferably from 1.5 to 3.

When the equivalent ratio is too high, the low temperature fixing property tends to degrade. When the equivalent ratio is too high, the anti-offset property tends to be insufficient.

The content of the composition deriving from the polyol in the polyester prepolymer having an isocyanate group is from 0.5 to 40% by weight, preferably from 1 to 30% by weight, and more preferably from 2 to 20% by weight.

A content that is too low may degrade the hot offset resistance of the toner. By contrast, when the content is too high, the low temperature fixability of the toner easily deteriorates.

In addition, the average number of the isocyanate groups per molecule of the polyester prepolymer is preferably 1 or more, more preferably from 1.2 to 5 and furthermore preferably from 1.5 to 4.

When the average number is too small, the molecular weight of a urea-modified polyester resin decreases, which may lead to deterioration of hot offset resistance.

The weight ratio of a polyester prepolymer having an isocyanate group to a polyester resin containing an adduct of bisphenol with propylene oxide in an amount of 50 mol % or more in the diol component mentioned above in an oil phase with a particular hydroxyl value and an acid value is preferably from 5/95 to 25/75 and more preferably from 10/90 to 25/75.

A weight ratio that is too low may degrade the hot offset resistance of the toner. By contrast, when the weight ratio is too high, the low temperature fixing property of the toner and the gloss of output images easily deteriorate.

Therefore, specific examples of the adhesive base materials include, but are not limited to, a mixture of a product obtained by urea-modifying a polyester prepolymer obtained by reaction of a polycondensation product of an adduct of bisphenol A with 2 mole of propylene oxide and isophthalic acid with isophorone diisocyanate by isphorone diamine, and a polycondensation product of an adduct of bisphenol A with 2 mole of propylene oxide and isophthalic acid; a mixture of a product obtained by urea-modifying a polyester prepolymer obtained by reaction of a polycondensation product of an adduct of bisphenol A with 2 mole of ethylene oxide and isophthalic acid with isophorone diisocyanate by isphorone diamine, and a polycondensation product of an adduct of bisphenol A with 2 mole of propylene oxide and terephthalic acid; a mixture of a product obtained by urea-modifying a polyester prepolymer obtained by reaction of a polycondensation product of an adduct of bisphenol A with 2 mole of ethylene oxide, an adduct of bisphenol A with 2 mole of propylene oxide, and terephthalic acid with isophorone diisocyanate by isphorone diamine, and a polycondensation product of an adduct of bisphenol A with 2 mole of ethylene oxide, an adduct of bisphenol A with 2 mole of propylene oxide (in which the ratio of adduct of bisphenol A with 2 mole of propylene oxide is 50 mol % or more), and terephthalic acid; a mixture of a product obtained by urea-modifying a polyester prepolymer obtained by reaction of a polycondensation product of an adduct of bisphenol A with 2 mole of ethylene oxide, an adduct of bisphenol A with 2 mole of propylene oxide, and terephthalic acid with isophorone diisocyanate by isphorone diamine, and a polycondensation product of an adduct of bisphenol A with 2 mole of propylene oxide, and terephthalic acid; a mixture of a product obtained by urea-modifying a polyester prepolymer obtained by reaction of a polycondensation product of an adduct of bisphenol A with 2 mole of ethylene oxide, and terephthalic acid with isophorone diisocyanate by hexamathylene diamine, and a polycondensation product of an adduct of bisphenol A with 2 mole of propylene oxide, and terephthalic acid; a mixture of a product obtained by urea-modifying a polyester prepolymer obtained by reaction of a polycondensation product of an adduct of bisphenol A with 2 mole of ethylene oxide, and terephthalic acid with isophorone diisocyanate by hexamathylene diamine, and a polycondensation product of an adduct of bisphenol A with 2 mole of ethylene oxide, an adduct of bisphenol A with 2 mole of propylene oxide (in which the ratio of adduct of bisphenol A with 2 mole of propylene oxide is 50 mol % or more), and terephthalic acid; a mixture of a product obtained by urea-modifying a polyester prepolymer obtained by reaction of a polycondensation product of an adduct of bisphenol A with 2 mole of ethylene oxide, and terephthalic acid with isophorone diisocyanate by ethylene diamine, and a polycondensation product of an adduct of bisphenol A with 2 mole of propylene oxide, and terephthalic acid; a mixture of a product obtained by urea-modifying a polyester prepolymer obtained by reaction of a polycondensation product of an adduct of bisphenol A with 2 mole of ethylene oxide, and terephthalic acid with isophorone diisocyanate by hexamethylene diamine, and a polycondensation product of an adduct of bisphenol A with 2 mole of propylene oxide, and isophthalic acid; a mixture of a product obtained by urea-modifying a polyester prepolymer obtained by reaction of a polycondensation product of an adduct of bisphenol A with 2 mole of ethylene oxide, an adduct of bisphenol A with 2 mole of propylene oxide, terephthalic acid, and an anhydride of dodecenyl succinic acid with diphenyl methane diisocyanate by hexamathylene diamine, and a polycondensation product of an adduct of bisphenol A with 2 mole of ethylene oxide, an adduct of bisphenol A with 2 mole of propylene oxide (in which the ratio of adduct of bisphenol A with 2 mole of propylene oxide is 50 mol % or more), and terephthalic acid; a mixture of a product obtained by urea-modifying a polyester prepolymer obtained by reaction of a polycondensation product of an adduct of bisphenol A with 2 mole of ethylene oxide, and isophthalic acid with toluene diisocyanate by hexamethylene diamine, and a polycondensation product of an adduct of bisphenol A with 2 mole of propylene oxide, and isophthalic acid; and a mixture of a product obtained by urea-modifying a polyester prepolymer obtained by reaction of a polycondensation product of an adduct of bisphenol A with 2 mole of ethylene oxide, an adduct of bisphenol A with 2 mole of propylene oxide, terephthalic acid, and trimellitic acid with isophorone diisocyanate by a ketimine compound in which the amino group is blocked by a ketone, and a polycondensation product of an adduct of bisphenol A with 2 mole of ethylene oxide, an adduct of bisphenol A with 3 mole of propylene oxide (in which the ratio of adduct of bisphenol A with 3 mole of propylene oxide is 50 mol % or more), terephthalic acid, adipic acid, and trimellitic acid.

The toner of the present disclosure is used after external additives are attached thereto.

Any known organic particulates such as PMMA and inorganic particulates are suitably selected as the external additives.

Specific examples of such inorganic particulates include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

These can be used alone or in combination.

The inorganic particulate preferably has a primary particle diameter of from 5 nm to 2 μm, and more preferably from 5 nm to 500 nm.

In addition, the specific surface area of such inorganic particulates measured by the BET method is preferably from 20 to 500 $m^2/g$.

The content of the inorganic particulates in the toner is preferably from 0.01 to 5.0% by weight and more preferably from 0.01 to 5.0% by weight.

These inorganic particulates are surface treated in terms of improvement of fluidity, blocking property, storage, and water-resistance.

Specific examples of the surface treatment agents include, but are not limited to, silane coupling agents, silylation agents, silane coupling agents including a fluoroalkyl group, organic titanate coupling agents, aluminum coupling agents, silicone oils, and modified silicone oils.

Below is a description of one method of forming mother toner particles while forming an adhesive substrate material.

This method includes preparation of an aqueous medium phase, preparation of an oil phase containing toner materials, emulsification or dispersion of a toner material, formation of adhesive substrate material, removal of solvent, polymerization of a polymer reactive with an active hydrogen group and synthesis of a compound having an active hydrogen group.

The aqueous medium is prepared by, for example, dispersing resin particles in an aqueous medium.

The addition amount of resin particles in an aqueous medium is preferably from 0.5 to 10% by weight.

The oil phase containing the toner material is prepared by dissolving or dispersing the toner material a compound having an active hydrogen group, a polymer having a portion reactive with a compound having an active hydrogen group, a coloring agent, a releasing agent, a charge control agent, and the polyester resin specified above in a solvent.

In the toner material, the component except for the polymer having a portion reactive with a compound having an active hydrogen group, the coloring agent, and the polyester resin can be added and mixed in an aqueous medium when resin particulates are dispersed in an aqueous medium or added to an aqueous medium when the oil phase containing the toner material is added to the aqueous medium.

The toner material can be emulsified or dispersed by dispersing the oil phase containing the toner material in an aqueous medium.

When the toner material is emulsified or dispersed, an adhesive base material can be formed by conducting an elongation reaction and/or a cross-linking reaction of a compound having an active hydrogen group and a polymer having a portion reactive with an active hydrogen group.

Adhesive base materials such as urea-modified polyester based resins can be prepared by, for example, conducting elongation reaction and/or cross-linking reaction by emulsifying and/or dispersing an oil phase containing a polymer reactive with an active hydrogen group of a polyester prepolymer having an isocyanate group, etc. and a compound having an active hydrogen group such as amines in an aqueous medium; preliminarily emulsifying and/or dispersing an oil phase containing a toner material in an aqueous medium to which a compound having an active hydrogen is added followed by elongation reaction and/or cross-linking reaction of both; or emulsifying and/or dispersing an oil phase containing a toner material in an aqueous medium and then adding a compound having an active hydrogen group to conduct elongation reaction and/or cross-linking reaction of both from the particle interface.

When the elongation reaction and/or the cross-linking reaction is conducted in an aqueous medium from the particle interface, a urea-modified polyester resin is preferentially formed on the surface of a toner particle, meaning that gradient of the concentration of the modified polyester resin can be generated in the thickness direction of a toner particle.

The reaction condition of forming an adhesive base material can be suitably selected depending on the combination of the polymer having a portion reactive with a compound having an active hydrogen group and a compound having an active hydrogen group.

The reaction time is preferably from 10 minutes to 40 hours, and preferably from 2 to 24 hours.

The reaction temperature is preferably from 0 to 150° C. and more preferably from 40 to 98° C.

A specific example of methods of stably forming a liquid dispersion containing a polymer having a portion reactive with a compound having an active hydrogen group (e.g., a polyester prepolymer having an isocyanate group) in an aqueous medium is a method in which an oil phase prepared by dissolving or dispersing a toner material containing, for example, a polymer having a portion reactive with a compound having an active hydrogen group, a coloring agent, a releasing agent, a charge control agent and the polyester resin specified above, is added to an aqueous medium phase followed by dispersion by shearing.

Any known dispersion device can be used for dispersion. Specific examples of such dispersion devices include, but are not limited to, a low speed shearing type dispersion device, a high speed shearing type dispersion device, an abrasion type dispersion device, a high pressure jet type dispersion device, and an ultrasonic dispersion device. Among these, the high speed shearing type dispersion device is preferable because it can control the particle diameter of the dispersion body in a range of from 2 to 20 μm.

When the high speed shearing type dispersion device is used, conditions such as the number of rotation, the dispersion time, and the dispersion temperature are suitably selected.

The number of rotation is preferably from 1,000 to 30,000 rpm, and more preferably from 5,000 to 20,000 rpm.

The dispersion time is preferably from 1 to 5 minutes in the case of the batch system. The dispersion temperature is preferably from 0 to 150° C. and more preferably from 40 to 98° C. under pressure.

Generally, dispersion is easy at a high temperature.

The content of the aqueous medium to emulsify and/or disperse a toner material is preferably from 50 to 2,000 parts by weight and more preferably from 100 to 1000 parts by weight base on 100 parts by weight of the resin. A content that is too small tends to cause deterioration of the dispersion status of a toner material and the resultant mother toner particle may not have a desired particle diameter. A content that is too large easily results in a rise in the production cost.

In the process of emulsifying and/or dispersing an oil phase containing a toner material, a dispersing agent is preferably used to stabilize the dispersion body of oil droplets, and make them have a desired form with a sharp particle size distribution.

Specific examples of the dispersion agents include, but are not limited to, surface active agents, inorganic compound dispersion agents hardly soluble in water, and polymer protective colloid. Among these, surface active agents are preferable.

These can be used alone or in combination.

Specific examples of surface active agents include, but are not limited to, anionic surface active agents, cationic surface active agents and non-ion active agents and ampholytic surface active agents.

Specific examples of anionic surface active agents include, but are not limited to, alkylbenzene sulfonic acid salts, α-olefin sulfonic acid salts, and phosphoric acid salts and an anionic surface active agent having a fluoroalkyl group is preferably used.

Specific examples of the anionic surface active agents having a fluoroalkyl group include, but are not limited to, fluoroalkyl carboxylic acids having from 2 to 10 carbon atoms and their metal salts, disodium perfluorooctanesulfonylglutamate, sodium 3-{ω-fluoroalkyl(C6-C11)oxy}-1-alkyl (C3-C4) sulfonate, sodium 3-{ω-fluoroalkanoyl(C6-C8)-N-ethylamino}-1-propanesulfonate, fluoroalkyl(C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl (C6-C10)-N-ethylsulfonyl glycin, monoperfluoroalkyl(C6-C16)ethylphosphates, etc.

Specific examples of the marketed products of such surfactants having a fluoroalkyl group include, but are not limited to, SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; and FUTARGENT F-100 and F150 manufactured by Neos.

Specific examples of the cationic surface active agents include, but are not limited to, amine salt type surface active agents such as alkyl amine salts, aminoalcohol fatty acid derivatives, polyamine fatty acid derivatives, and quaternary ammonium salt type surface active agents such as alkyl trimethyl ammonium salts, dialkyl dimethyl ammonium salts, alkyl dimethyl benzyl ammonium salts, pyridinium salts, alkyl isoquinolinium salts, and benzetonium chloride.

Among these, preferred specific examples of cationic surface agent include, but are not limited to, primary, secondary and tertiary aliphatic amines having a fluoroalkyl group, aliphatic quaternary ammonium salts, for example, perfluoroalkyl(C6-C10) sulfoneamide propyltrimethyl ammonium salts, benzalkonium salts, benzetonium chloride, pyridinium salts, imidazolinium salts, etc.

Specific examples of the marketed products thereof include, but are not limited to, SURFLON S-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); and FUTARGENT F-300 (from Neos).

Specific examples of the nonionic surface active agents include, but are not limited to, fatty acid amide derivatives, and polyalcohol derivatives.

Specific examples of amopholytic surface active agents include, but are not limited to, alanine, dodecyldi(amino ethyl)glycine, di(octyl amonoethyl)glycine, and N-alkyl-N,N-dimethyl ammonium betaine.

Specific examples of inorganic dispersing agents hardly soluble in water include, but are not limited to, tricalcium phosphate, calcium carbonate, titanium oxide, colloidal silica, and hydroxyapatite.

Specific examples of the polymer protective colloids include, but are not limited to, monomers having a carboxyl group, alkyl (meth)acrylate having a hydroxyl group, vinyl ethers, vinyl carboxylate, amide monomers, monomers acid chlorides, homopolymers or copolymers obtained by polymerizing monomers having a nitrogen atom or heterocyclic ring having a nitrogen atom, etc., polyoxyethylene based resins, and celluloses.

The homopolymers or copolymers obtained by polymerizing the monomers mentioned above include polymers having a composition unit originating from vinyl alcohol.

Specific examples of monomers having a carboxyl group include, but are not limited to, acrylic acid, methacrylic acid, α-cyanoacrylic acid, α-cyanomethacrylic acid, itaconic acid, crotonic acid, fumaric acid, maleic acid and maleic anhydride.

Specific examples of (meth)acrylic monomers having a hydroxyl group include, but are not limited to, β-hydroxyethyl acrylate, β-hydroxyethylmethacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylate, diethyleneglycolmonomethacrylate, glycerinmonoacrylate, and glycerinmonomethacrylate.

Specific examples of vinyl ethers include, but are not limited to, vinyl methyl ether, vinyl ethyl ether and vinyl propyl ether.

Specific examples of the vinyl carboxylate include, but are not limited to, vinyl acetate, vinyl propionate and vinyl butyrate.

Specific examples of the amide monomers include, but are not limited to, acrylamide, methacrylamide, diacetone acrylamide acid, N-methylolacryl amide, and N-methylolmethacryl amide.

Specific examples of the acid chlorides include, but are not limited to, chloride acrylate, and chloride methacrylate.

Specific examples of the monomers having a nitrogen atom or heterocyclic ring having a nitrogen atom include, but are not limited to, vinyl pyridine, vinyl pyrrolidone, vinyl imidazole and ethylene imine.

Specific examples of the polyoxyethylene resins mentioned above include, but are not limited to, polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl, and polyoxyethylene pelargonic esters.

Specific examples of celluloses include, but are not limited to, methyl cellulose, hydroxyethyl cellulose and hydroxypropyl cellulose.

Specific examples of the dispersion agents include, but are not limited to, compounds soluble in an alkali or an acid such as calcium phosphate.

When calcium phosphate is used, the salt of calcium phosphate can be removed by, for example, a method of dissolving the calcium salt by hydrochloric acid, etc., followed by washing with water, or a method of enzymatic decomposition.

Catalysts can be used for elongation reaction and/or cross-linking reaction when forming an adhesive base material.

Specific examples of the catalysts include, but are not limited to, dibutyl tin laurate, and dioctyl tin laurate.

The organic solvent is removed from a liquid dispersion such as emulsified slurry by, for example, a method of evaporating the organic solvent in oil droplets by gradually heating the entire reaction system, or a method of spraying a liquid dispersion in dried atmosphere to remove both of the organic solvent in oil droplets.

When the organic solvent is removed, mother toner particles are formed.

The mother toner particles can be washed and dried and optionally classified.

For example, the mother toner particles can be classified by removing fine particles by a cyclone, a decanter, a centrifugal, etc., or dried mother toner particles can be classified.

The thus obtained mother toner particles are optionally mixed with particles such as a releasing agent, and a charge control agent.

Particles such as a releasing agent can be prevented from detaching from the surface of the mother toner particles by applying a mechanical impact.

Specific examples of such mechanical impact application methods include, but are not limited to, methods in which an impact is applied to a mixture by using a blade rotating at a high speed, a method in which a mixture is put into a jet air to collide particles against each other or into a collision plate.

Specific examples of such mechanical impact applicators include, but are not limited to, ONG MILL (manufactured by Hosokawa Micron Co., Ltd.), modified I TYPE MILL (manufactured by Nippon Pneumatic Mfg. Co., Ltd.) in which the pressure of pulverization air is reduced, HYBRIDIZATION SYSTEM (manufactured by Nara Machine Co., Ltd.), KRYPTRON SYSTEM (manufactured by Kawasaki Heavy Industries, Ltd.), automatic mortars, etc.

The toner of the present disclosure contributes to forming quality images because it has a smooth surface and thus excellent characteristics such as transfer property and chargeability.

In addition, the toner of the present disclosure has excellent transfer property and fixing property when the toner contains an adhesive base material obtained by reacting a compound having an active hydrogen group, and a polymer reactive with an active hydrogen group.

The toner of the present disclosure can be used in various kinds of fields and particularly for image formation according to electrophotography.

The toner preferably has a volume average particle diameter of from 3 to 8 μm and more preferably from 4 to 7 μm. When the volume average particle diameter is too small, toner for use in a two-component developing agent containing the toner and carriers may be attached to the surface of carriers during agitation in a developing unit for an extended period of time, which may lead to the deterioration of the charging ability of the carrier.

In addition, in the case of a one component developing agent containing the toner, filming of the toner to a developing roller and attachment of a toner to a part, for example, a blade for regulating the layer thickness of the toner, may occur. When the volume average particle diameter is too large, it tends to be difficult to obtain quality images with high definition and the particle diameter of a toner may greatly vary when the toner contained in the developing agent is replenished.

The ratio of the volume average particle diameter to the number average particle diameter is preferably from 1.00 to 1.25 and more preferably from 1.05 to 1.25.

When a two-component development agent is used and replenished a number of times for an extended period of time, the variability of the particle diameter of the toner is small. In addition, good and stable developability is sustained even when the development agent is stirred in a development device for an extended period of time so that quality images can be stably produced.

In addition, when a single-component development agent is used and replenished a number of times, the variability of the particle diameter of the toner is small and filming of the toner on the developing roller and fusion bonding of the toner onto members such as a blade for regulating the thickness of the toner layer, hardly occurs. Therefore, good and stable developability is sustained even when the development agent is stirred for an extended period of time so that quality images can be produced.

When the ratio is too large, it tends to be difficult to obtain quality images with a high definition and the particle diameter of a toner may markedly vary when the toner contained in the development agent is replenished.

The volume average particle diameter and the ratio of the volume average particle diameter to the number average particle diameter can be measured by using the particle size measuring device MULTISIZER (manufactured by Beckman Coulter, Inc.) as follows: Add 0.1 to 5 ml of alkyl benzene sulfuric acid salt, etc., as a dispersing agent in 100 to 150 ml of electrolyte aqueous solution such as about 1% by weight NaCl aqueous solution; Add about 2 to 20 mg of a measuring sample thereto; Disperse the electrolyte aqueous solution in which the sample is suspended with a supersonic dispersion device for about 1 to 3 minutes; and measure the volume or the number of the toner with 100 μm aperture for calculation of the volume distribution and the number distribution.

The volume average particle diameter and the number particle diameter of the toner can be obtained from the thus obtained volume distribution and number distribution.

The development agent containing the toner of the present disclosure also optionally contains other components such as carriers.

Therefore, transfer property and chargeability are excellent so that quality images are stably output.

The development agent such as a one-component development agent and a two-component development agent can be used and the two-component development agent is preferable in terms of life length thereof particularly when used in a high speed printer that meets the demand of high speed information processing speed of late.

When a development agent using the toner of the present disclosure is used as a single-component development agent and replenished a number of times, the variability of the particle diameter of the toner is small and filming of the toner on the developing roller and fusion bonding of the toner onto members such as a blade for regulating the thickness of the toner layer, hardly occurs. Therefore, good and stable developability is sustained even when the development agent is stirred for an extended period of time in a development device so that quality images with good developability can be suitably produced.

When a development agent using the toner of the present disclosure is used as a two-component development agent and replenished a number of times, the variability of the particle diameter of the toner is small. In addition, good and stable developability is sustained even when the development agent is stirred for an extended period of time so that quality images can be produced.

Carriers can be suitably selected and it is preferred that carrier particles have a core and a resin layer that covers the core.

The materials of the core can be selected from known materials and manganese-strontium based material or manganese-magnesium based material having 50 to 90 emu/g.

The core preferably has a volume average particle diameter of from 10 to 150 μm and more preferably from 40 to 100 μm.

When the volume average particle diameter is too small, the ratio of fine particles in carriers tends to increase and the magnetization per particle tends to decrease, which may lead to scattering of carriers. When the volume average particle diameter is too large, the specific surface area tends to decrease, which may cause scattering of toner. Thus, the representation of the solid portion may deteriorate particularly in the case of a full color image having a large solid portion area.

The content of the carrier in the two-component development agent is preferably from 90 to 98% by weight and more preferably from 93 to 97% by weight.

Having generally described (preferred embodiments of) this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Examples 1 to 11

Synthesis of Binder Resin

The following components are placed in a reaction container equipped with a condenser, stirrer and a nitrogen introducing tube to conduct a reaction at 230° C. for 8 hours:

| | |
|---|---|
| Adduct of bisphenol A with 2 mol of ethylene oxide | 67 parts |
| Adducts of bisphenol A with 3 mol of propion oxide | 84 parts |

Terephthalic Acid parts Another reaction is conducted for 5 hours with a reduced pressure of 10 to 15 mmHg and 22 parts by weight of trimellitic anhydride is added to the reaction container to synthesize polyester resins having a melting point and an acid value shown in Table 1-1 under normal pressure while changing the reaction temperature and the reaction time.

The obtained polyester resin has a number average molecular weight (Mn) of 2,100, and a weight average molecular weight 8 Mw) of 5,600, a glass transition temperature of 55° C. and an acid value of 15.3 mgKOH/g.

Manufacturing Example of Toner

Manufacturing Examples of Toner of Examples 1 to 11

Preparation of Coloring Agent Dispersion Body 100 parts of the polyester resin shown in Table 1-1, 75 parts of one of the press cake pigments of quinacridone pigments (C.I. Pigment Red 122, pigment content: 40%) of Examples 1 to 10 or 30 parts of powder pigment of quinacridone pigment of Example 11, and 20 parts of one of the releasing agents having a melting point, an acid value, and a viscosity shown in Table 1-2 are mixed with HENSCHEL MIXER (manufactured by Mitsui Mining Company, Limited) at 1,000 rpm for 5 minutes followed by melting, mixing and kneading by an oven roll kneader (manufactured by Mitsui Mining Company, Limited), and pulverization by a ROTOPLEX pulverizer to manufacture powder of coloring agent dispersion body having a size of about 2 mm.

The acid paraffins as the releasing agents of Example 1 and 3 to 11 having a melting point, an acid value, and a viscosity at 90° C. shown in Table 1-2 are obtained by changing the modification amount of the carboxylic acid.

The releasing agent used in Example 2 is carnauba wax, which is not acid-modified is used.

Preparation of Liquid Dispersion of Toner Material

The coloring agent dispersion body is added to 100 parts of the polyester resin shown in Table 1-1 such that the content of the pigment in the toner is 9 parts, and the content of the releasing agent is 6 parts. Thereafter, the resultant and 1 part of a metal complex of salicylic acid (E-84 from Orient Chemical Industries Co., Ltd.) are set in ethyl acetate while stirring and heated to 80° C. After 5 hours at 80° C., the system is cooled down to 30° C. in one hour to prepare a material solution.

This material solution is stirred for 30 minutes by using T.K. HOMODISPER (manufactured by Tokushu Kika Kogyo Co., Ltd.) to obtain a liquid dispersion of a toner material.

Manufacturing of Mother Toner Particle

The following shown below is mixed and stirred to obtain an aqueous medium:

| | |
|---|---|
| Water | 100 parts |
| 48.5% aqueous solution of sodium dodecyldiphenyl etherdisulfonate (EREMINOR MON-7 from Sanyo Chemical Industries, Ltd.) | 6 parts |
| Polymer dispersion agent (1% by weight aqueous solution of polymer dispersion agent carboxymethyl cellulose sodium (CELLOGEN BS-H-3, manufactured by Dai-ichi Kogyo Seiyaku Kogyo Co., Ltd.) | 10 parts |
| Ethyl acetate | 10 parts |

Next, the thus obtained aqueous medium and the liquid dispersion of the toner material are added with a weight ratio of 1 to 1 followed by mixing with a TK type HOMOMIXER at 1,300 rpm for 20 minutes to prepare a liquid dispersion (emulsified slurry). Then, this emulsified slurry is placed in a reaction container equipped with a stirrer and a thermometer followed by removal of the solvent at 30° C. for 8 hours. Subsequent to a four hour aging at 45° C., a dispersion slurry is prepared.

After 100 parts of the dispersion slurry is filtered with a reduced pressure, 100 parts of deionized water is added to the filtered cake and mixed by a TK HOMOMIXER at a rotation number of 12,000 rpm for 10 minutes followed by filtration.

10 weight % hydrochloric acid is added to the thus obtained filtered cake such that the pH is adjusted to be 2.8. The resultant is mixed by a TK HOMOMIXER at a rotation number of 12,000 rpm for 10 minutes followed by filtration.

After 300 parts of deionized water is added to the filtered cake and the resultant is mixed by a TK HOMOMIXER at a rotation number of 12,000 rpm for 10 minutes, filtration is performed twice to obtain a final filtered cake.

The obtained final filtered cake is dried by a circulation drier at 45° C. for 48 hours. The dried cake is sieved using a screen having an opening of 75 μm to obtain mother toner particles.

Manufacturing of Toner for Evaluation 1.0 part of a hydrophobic silica and 0.5 parts of hydrophobic titanium oxide are externally added to 100 parts of the thus obtained mother toner particles followed by mixing with a HENSCHEL MIXER (manufactured by Mitsui Mining Company, Limited) to manufacture toner for evaluation.

Comparative Example 1

Manufacturing Example of Toner of Comparative Example 1

A toner is manufactured in the same manner as described in Example 1 except that the acid paraffin wax is not added when the coloring agent dispersion body is prepared but when the material solution is manufactured in preparation of the liquid dispersion of the toner material such that the addition amount in the toner is 6 parts.

TABLE 1-1

| | Resin | | |
|---|---|---|---|
| | Melting point (° C.) | Acid value (mgKOH/g) | Pigment form |
| Example 1 | 120 | 15.3 | Press cake |
| Example 2 | 120 | 15.3 | Press cake |
| Example 3 | 103 | 16.1 | Press cake |
| Example 4 | 120 | 15.3 | Press cake |
| Example 5 | 120 | 15.3 | Press cake |
| Example 6 | 120 | 15.3 | Press cake |
| Example 7 | 118 | 4.7 | Press cake |
| Example 8 | 123 | 46 | Press cake |
| Example 9 | 120 | 15.3 | Press cake |
| Example 10 | 120 | 15.3 | Press cake |
| Example 11 | 120 | 15.3 | Powder |
| Comparative Example 1 | 120 | 15.3 | Press cake |

TABLE 1-2

| | Releasing agent | | | |
|---|---|---|---|---|
| | Kind | Melting point (° C.) | Acid value (mgKOH/g) | Viscosity (cP) |
| Example 1 | Acid paraffin | 76 | 12.4 | 12 |
| Example 2 | Canauba wax | 84 | 8.5 | 15 |
| Example 3 | Acid paraffin | 108 | 10.5 | 35 |
| Example 4 | Acid paraffin | 123 | 8.9 | 43 |
| Example 5 | Acid paraffin | 81 | 1.2 | 15 |
| Example 6 | Acid paraffin | 96 | 23 | 23 |
| Example 7 | Acid paraffin | 76 | 12.4 | 12 |
| Example 8 | Acid paraffin | 76 | 12.4 | 12 |
| Example 9 | Acid paraffin | 77 | 10.8 | 3 |
| Example 10 | Acid paraffin | 104 | 9.6 | 63 |
| Example 11 | Acid paraffin | 76 | 12.4 | 12 |
| Comparative Example 1 | Acid paraffin | 76 | 12.4 | 12 |

The melting point and the acid value of the polyester resin and the releasing agent used in Examples 1 to 11 and Comparative Example 1 are measured as follows.

Method of Measuring Acid Value

Measuring is conducted in the following conditions according to the method described in JIS K0070-1992.

Sample preparation: Add and dissolve 0.5 g of a sample to 120 ml of toluene by stirring at room temperature (23 degree C.) for about 10 hours; and add 30 ml of ethanol to obtain a sample solution. The acid value is calculated by the device specified above. Specific calculation is as follows:

Titrate using preliminarily set alcohol solution of 0.1 N potassium hydroxide to obtain the acid value by the following relationship based on the consumption amount of the alcohol solution of potassium:

$$\text{Acid value}=\text{KOHX}(\text{number of ml})\times N\times 56.1/\text{sample weight},$$

where N represents a factor of 0.1N 0 KOH.

Measuring of Melting Point

In the present disclosure, the melting point is determined by the peak top representing the maximum endothermic amount of differential scanning calorimetry (DSC) curve in the measuring of DSC.

In addition, the melting point is measured under the following conditions by using TA-60WS and DSC-60, manufactured by Shimadzu Corporation.

Measuring Conditions

Sample container: Aluminum sample pan (with a lid)

Sample amount: 5 mg

Reference: Aluminum sample pan (alumina 10 mg)

Atmosphere: nitrogen (flow amount: 50 ml/min)

Temperature Conditions

Starting temperature: 20° C.

Heating speed: 10° C./min

Ending temperature: 150° C.

Holding time: None

Cooling speed: −10° C./min

Ending temperature: 20° C.

Holding time None

Heating speed: 10° C./min

Ending temperature: 150° C.

The toner obtained in Examples 1 to 11 and Comparative Example 1 are tested for a long run length and evaluated for color reproduction, and fixing property.

Evaluation of Fixing Property

The toner manufactured in Examples and Comparative Example is mixed and stirred with ferrite carrier having a particle diameter of 55 μm to obtain a two-component development agent for evaluation on actual machine.

The development agent is set in a photocopier (imageo Neo C600, manufactured by Ricoh Co., Ltd.) and an unfixed image having a rectangle form with a size of 3 cm×5 cm is formed on at a position of 3 cm from the front end of an A4 sheet (T6000, 70W, T machine translation, manufactured by Ricoh Co., Ltd.) with an attachment amount of 0.85 mg/cm$^2$.

This unfixed image is observed with naked eyes for evaluating occurrence of offset by using a machine remodeled based on the photocopier (imageo Neo C600, manufactured by Ricoh Co., Ltd.) such that fixing device therein can be externally driven and the temperature thereof can be externally controlled with a condition of a linear speed of 260 mm/s while changing the temperature from 120° C. to 200° C. with an interval of 5° C.

The criteria for cold offset are as follows:

G (Good): No occurrence of cold offset at 130° C. or higher

F (Fair): No occurrence of cold offset at 140° C. or higher

B (Bad): Cold offset occurs at 145° C. or higher

The criteria for hot offset are as follows:

G (Good): No occurrence of hot offset at 190° C. or lower

F (Fair): No occurrence of hot offset at 180° C. or lower

B (Bad): Cold offset occurs at 175° C. or lower

Evaluation on Color Reproduction

In the evaluation test for fixing, a solid image is formed and fixed as an evaluation sample on a transfer sheet (Tokubishi Art 110 kg, manufactured by Mitsubishi Paper Mills Limited.) with an attachment amount of 0.4 mg/cm$^2$) at a linear speed of 280 mm/s while controlling the temperature of the fixing member at 160° C.

With regard to the formed solid image, chromaticness index a* and b* in L*a*b* color coordinate system (CIE: 1976) are measured by a colorimeter (X-Rite 938, manufactured by X-Rite Corporation) and C* is obtained according to the following relationship and the chromaticness of each color toner is measured.

$$C^*=[(a^*)^2+(b^*)^2]^{1/2}$$

The criteria of the chromaticness are as follows.

E (Excellent): C* is 75 or greater

G (Good) C* is 73 to less than 75

F (Fair) C* is 70 to less than 73

B (Bad) C* is less than 70.

Long Run Length Test in High Temperature and High Moisture

The toner manufactured in Examples and Comparative Example is mixed and stirred with ferrite carrier having a particle diameter of 60 μm for 20 minutes with a toner density of 4% to obtain a two-component development agent.

A machine test with a run length of 50,000 sheets with a manual density of 5% by using a photocopier (imagio neo C355, manufactured by Ricoh Co., Ltd.) in an environment of a temperature of 35° C. and a moisture of 80% and the two-component development agent.

The image density is measured for the first image and 50,000th image by a densitometer remodeled based on a Macbeth densitometer (manufactured by GretagMacbeth Co., Ltd.) in order to measure thousandths.

The density of the plain sheet and the non-image portion of the fixed image is measured. The density difference of the two is evaluated according to the following criteria:

E (Excellent): less than 0.01

G (Good): 0.01 to less than 0.02

F (Fair): 0.02 to less than 0.03

B (Bad): 0.03 or greater

The evaluation results are shown in Table 2.

TABLE 2-1

| | Color reproduction property | | Machine test in high temperature and high moisture environment | |
|---|---|---|---|---|
| | Chromaticness (C*) | Evaluation | Temperature difference | Evaluation |
| Example 1 | 75.2 | E | 0.012 | G |
| Example 2 | 72.3 | F | 0.022 | F |
| Example 3 | 74.1 | G | 0.006 | E |
| Example 4 | 71.8 | F | 0.004 | E |
| Example 5 | 72.1 | F | 0.023 | F |
| Example 6 | 75.1 | E | 0.009 | E |
| Example 7 | 71.9 | F | 0.024 | F |
| Example 8 | 74.5 | G | 0.011 | G |
| Example 9 | 75.5 | E | 0.028 | F |
| Example 10 | 72.8 | F | 0.006 | E |
| Example 11 | 70.5 | F | 0.018 | G |
| Comparative Example 1 | 68.8 | B | 0.035 | B |

TABLE 2-2

| | Fixing property evaluation | | | | |
|---|---|---|---|---|---|
| | Cold offset temperature | Evaluation | Hot offset temperature | Evaluation | Total evaluation |
| Example 1 | 125 | G | 195 | G | E |
| Example 2 | 130 | F | 195 | G | G |
| Example 3 | 135 | F | 200 | G | G |
| Example 4 | 140 | F | 200 | G | G |
| Example 5 | 125 | G | 185 | F | G |
| Example 6 | 140 | F | 200 | G | G |
| Example 7 | 125 | G | 185 | F | G |
| Example 8 | 140 | F | 200 | G | G |
| Example 9 | 125 | G | 195 | G | G |
| Example 10 | 140 | F | 200 | G | G |
| Example 11 | 125 | G | 195 | G | G |
| Comparative Example 1 | 145 | F | 200 | G | B |

As seen in the results shown in Table 2, the toner of Comparative Example 1 is not formed by preliminarily melting, mixing, or kneading the releasing agent with the pigment and the binder resin and thus is bad in pigment dispersion property, color reproduction property, and chargeability, thereby causing background fouling.

By contrast, the toner of Examples 1 to 11 uses the coloring agent dispersion body formed by melting, mixing, and kneading the releasing agent, the pigment and the binder resin so that the toner apparently has an excellent color reproduction property and fixing property without causing background fouling in the machine run test in the high temperature and high moisture environment.

In addition, the toner of Example 2 uses carnauba wax which is non-acid modified as a releasing agent so that the toner is slightly inferior in the dispersion property, and the color reproduction property, the machine run test in the high temperature and high moisture environment, and cold offset temperature characteristics of the toner deteriorate.

With regard to the toner of Example 3, since the melting point of the acid paraffin is higher than that of the polyester resin in the binder resin, the cold offset temperature characteristic deteriorates.

With regard to the toner of Example 4, since the melting point of the acid paraffin is higher than 110° C., the color reproduction property, and the cold offset temperature characteristic deteriorate.

With regard to the toner of Example 5, since the acid value of the acid paraffin is 1.2 mgKOH/g, which is lower than 3 mgKOH/g, the color reproduction property, the machine run test in the high temperature and high moisture environment, and the hot offset resistance deteriorate.

With regard to the toner of Example 6, since the acid value of the acid paraffin is 23 mgKOH/g, which is higher than 20 mgKOH/g, the cold offset temperature characteristic deteriorates.

With regard to the toner of Example 7, since the acid value of the polyester resin in the binder resin is 4.7 mgKOH/g, which is less than 5 mgKOH/g), the color reproduction property, the machine run test in the high temperature and high moisture environment, and the hot offset resistance deteriorate.

With regard to the toner of Example 8, since the acid value of the polyester resin in the binder resin is 46 mgKOH/g, which is higher than 40 mgKOH/g, the cold offset temperature characteristic deteriorates.

With regard to the toner of Example 9, since the viscosity of the acid paraffin at 90° C. is 3 cm poise, which is lower than 5 cm poise, the machine run test in the high temperature and high moisture environment deteriorates.

With regard to the toner of Example 10, since the viscosity of the acid paraffin at 90° C. is 63 cm poise, which is higher than 50 cm poise, the color reproduction property, and the cold offset temperature characteristic deteriorate.

With regard to the toner of Example 10, since the powder pigment is used as the coloring agent in the coloring agent dispersion body in which the releasing agent, the coloring agent, and the binder resin, the color reproduction property deteriorates.

By contrast, with regard to the toner of Example 1, the polyester resin in the binder resin has an acid value of 15.3 mgKOH/g, which is in the rage of from 5 to 40 mgKOH/g, the releasing agent in the toner of Example 1 is the acid paraffin, the melting point of the releasing agent is 76° C., which is in the range of from 70 to 110° C., the acid value of the releasing agent is 12.4 mgKOH/g, which is in the range of from 3 to 20 mgKOH/g, and the viscosity of the releasing agent is 12 cm poise, which is in the range of from 5 to 50 cm poise.

In addition, since the press cake pigment is used as the coloring agent, the color reproduction property, the machine run test in the high temperature and high moisture environment, the cold offset temperature characteristic, and the hot offset resistance are apparently better than the toner of any other Example.

Example 12

A toner material liquid dispersion is obtained in the same manner as in Preparation of Liquid Dispersion of Toner Material of Example except that the amount of the polyester resin shown in Table 1-1 is changed from 100 parts to 90 parts and 10 parts of a prepolymer is used which is prepared as follows:

Mother toner particles of Example 12 are manufactured in the same manner as Manufacturing of Mother Toner Particle in Example 1 except that the thus prepared toner material liquid dispersion is used. Thereafter, toner for evaluation is manufactured in the same manner as in Manufacturing of Toner for Evaluation of Example 1.

Preparation of Polyester Prepolymer Solution

The following components are placed in a container equipped with a condenser, a stirrer and a nitrogen introducing tube to conduct a reaction at 230° C. at normal pressure for 8 hours followed by another reaction for 5 hours with a reduced pressure of 10 to 15 mmHg to synthesize an intermediate polyester resin:

Adduct of bisphenol A with 2 mole of ethylene oxide: 682 parts

Adduct of bisphenol A with 2 mole of propylene oxide: 81 parts

Terephthalic acid: 283 parts

Trimellitic anhydride: 22 parts

Dibutyl tin oxide: 2 parts

Then, the resultant is caused to conduct 5 hour reaction with a reduced pressure of 10 to 15 mm Hg to synthesize an intermediate polyester resin.

The intermediate polyester resin has an Mn of 2,100, Mw of 9,600, a Tg of 55 degree C., an acid of 0.5 mgKOH/g, and a hydroxyl value of 49 mgKOH/g.

Next, 411 parts of [Intermediate polyester 1], 89 parts of isophorone diisocyanate, and 500 parts of ethyl acetate are placed in a reaction container equipped with a condenser, stirrer and a nitrogen introducing tube to conduct reaction at 100° C. for 5 hours to prepare a polyester prepolymer. The obtained polyester prepolymer has a solid portion density of 50% (150° C. left for 45 minutes) and the content of isolated isocyanate of the polyester prepolymer is 1.60%.

Evaluation Results

With regard to the thus obtained toner, as a result of evaluation on the color reproduction property, the machine run test in the high temperature and high moisture environment, and the fixing property. the chromaticness (C*) is 73.1, which is evaluated as G (Good). The density difference in the machine run test in the high temperature and high moisture environment is 0.018, which is evaluated as G (Good).

In addition, the cold offset temperature is 125° C., which is evaluated as G (Good). The hot offset temperature is 200° C., which is evaluated as G (Good). The total evaluation of the toner of Example 12 is E (Excellent).

This document claims priority and contains subject matter related to Japanese Patent Application no. 2009-222189, filed on Sep. 28, 2009, the entire contents of which are hereby incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A method of manufacturing toner, comprising:

melting, mixing, and kneading a releasing agent and a coloring agent with at least part of a polyester binder resin to form a toner material where the releasing agent is dispersed in at least part of said polyester binder resin;

pulverizing the toner material to form a powder comprised of said releasing agent, said coloring agent, and at least part of said polyester binder resin;

dissolving said powder in an oil phase; and suspending said oil phase comprising said powder, dissolved in the oil, in an aqueous medium to obtain a toner that does not exhibit cold offset at a temperature of 140° C. or higher, wherein the polyester binder resin comprises a polyol component that comprises at least 50 mol % of an adduct of propylene oxide and a bisphenol, based on the diol component of the polyester resin, a melting point of the releasing agent is from 70 to 110° C., and a content of said polyester binder resin having a weight average molecular weight of less than 1,000 is from 8 to 28% by weight of said polyester binder resin.

2. The method of manufacturing toner according to claim 1, wherein the releasing agent is a hydrocarbon-based wax modified by a carboxylic acid or an anhydride of a carboxylic acid.

3. The method of manufacturing toner according to claim 1, wherein a melting point of the releasing agent is lower than a melting point of the binder resin.

4. The method of manufacturing toner according to claim 1, wherein an acid value of the releasing agent ranges from 3 to 20 mgKOH/g.

5. The method of manufacturing toner according to claim 1, wherein an acid value of the polyester resin ranges from 5 to 40 mgKOH/g.

6. The method of manufacturing toner according to claim 1, wherein the releasing agent has a viscosity of from 5 to 50 cm poise at 90° C.

7. The method of manufacturing toner according to claim 1, wherein the coloring agent comprises a press cake pigment formed by washing and filtering the pigment.

8. The method of manufacturing toner according to claim 1, wherein the melting, mixing, kneading of the binder resin, the releasing agent, and the coloring agent is conducted using an open-type melting, mixing and kneading machine.

9. The method of manufacturing toner according to claim 1, wherein said melting, mixing, and kneading is a preliminary melting, mixing, and kneading where each of the melting, mixing, and kneading are carried out prior to said suspending and granulating.

10. A method of manufacturing toner, comprising:

melting, mixing, and kneading a releasing agent and a coloring agent with at least part of a polyester binder resin; and suspending and granulating an oil phase comprising the binder resin, the coloring agent, and the releasing agent in an aqueous medium to obtain a toner, wherein a melting point of the releasing agent ranges from 70 to 110° C., a melting point of the polyester binder resin ranges from 103 to 120° C., an acid value of the releasing agent ranges from 1.2 to 23 mgKOH/g, an acid value of the polyester resin ranges from 5 to 40 mgKOH/g, and provided at least one of the following:

the melting point of the releasing agent is lower than the melting point of the binder resin, and the acid value of the releasing agent is lower than the acid value of the binder resin.

11. The method of manufacturing toner according to claim 9, wherein a melting point of the releasing agent ranges from 76 to 108° C., a melting point of the polyester binder resin ranges from 103 to 120° C., an acid value of the releasing agent ranges from 1.2 to 23 mgKOH/g, and an acid value of the polyester resin ranges from 4.7 to 16.1 mgKOH/g.

* * * * *